United States Patent [19]

Barr

[11] 4,166,346

[45] Sep. 4, 1979

[54] PREFABRICATED DOOR ASSEMBLY

[76] Inventor: Gerald L. Barr, 11041 Lake Hazil Rd., Boise, Id. 83705

[21] Appl. No.: 905,729

[22] Filed: May 15, 1978

[51] Int. Cl.[2] ..... E06B 1/04

[52] U.S. Cl. ..... 52/211; 49/504

[58] Field of Search ..... 52/204–217; 49/504

[56] References Cited

U.S. PATENT DOCUMENTS

| | | | |
|---|---|---|---|
| 3,040,390 | 6/1962 | Carlton | 52/211 |
| 3,239,978 | 3/1966 | Parker | 52/211 |
| 3,338,008 | 8/1967 | Sklar | 52/211 |
| 3,429,076 | 2/1969 | Fortsch et al. | 52/211 X |

FOREIGN PATENT DOCUMENTS

| | | | |
|---|---|---|---|
| 555744 | 4/1958 | Canada | 52/211 |
| 759197 | 5/1967 | Canada | 52/211 |

*Primary Examiner*—J. Karl Bell

*Attorney, Agent, or Firm*—Paul F. Horton

[57] ABSTRACT

Prefabricated door assembly for installation in a roughed-in door frame, the assembly including a pair of vertically extending door jambs having inter-engaging casings and a header unit spanning the upper ends of the door jambs. The header unit includes a header board having interengaging horizontal casings.The header board also includes, adjacent each of its ends, a transverse recess designed to receive the upper end of each of the jambs, the recess having a slightly outward inclination to place a constant tension on the jambs as they engage the roughed-in door frame. The assembly may also include means for placing a downward pressure on the header board to maintain integrity of the joints.

4 Claims, 5 Drawing Figures

PREFABRICATED DOOR ASSEMBLY

BACKGROUND OF THE INVENTION

1. Field of the Invention

This invention relates, in general, to prefabricated door frames, and in particular to door frames constructed to minimize separation of joints.

2. Description of the Prior Art

The disadvantages of conventional construction of door assemblies on the construction site are well known. Skilled craftsmen are required and the construction is time consuming resulting in higher costs. To overcome these inherent disadvantages, the building industry has largely depended on prefabricated assemblies. Prefabricated assemblies of unitary construction have the disadvantages of fitting only one size of door frame opening and of being large and ungainly and therefor inefficient to ship. In attempting to overcome these problems, the art, more recently, has turned to knock down prefabricated door assemblies as typified by U.S. Pat. No. 3,338,008 issued to S. Sklar, U.S. Pat. No. 3,239,978 issued to J. H. Parker, and U.S. Pat. No. 3,250,049 also issued to S. Sklar. While solving the problems of shipping costs and door size, such assemblies heretofor, resulted in door assemblies which had a tendency to become loose at their connective joints and to become detached from the roughed in door frame.

SUMMARY OF THE INVENTION

The present invention comprises, generally, a prefabricated door assembly including a header member having recesses for receiving the top portion of the two side jambs. The recesses have a slight outward inclination imparting a springiness to the side jambs as they contact the roughed in door frame. The invention also includes pressure means extending between the header and top of the door frame which maintains a constant downward and outward tension on the side jambs. The claims may be referred to for a more comprehensive description of the invention.

It is therefor a general object of the present invention to provide a prefabricated door assembly which is conveniently and inexpensively shipped, assembled, and which is designed to insure the integrity of the connecting joints.

More particularly it is an object of the present invention to provide a prefabricated door assembly in which the jambs are "toed out" in their engagement with a header member.

It is a further object of the present invention to provide a prefabricated door assembly having header pressure means to provide a downward bias on the header in relationship to the top of the roughed in door frame.

A still further object of the present invention is to provide a prefabricated door assembly having joints providing an outward bias to the door jambs in combination with adjustable header pressure means providing a downward bias on the header and thus the jambs.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
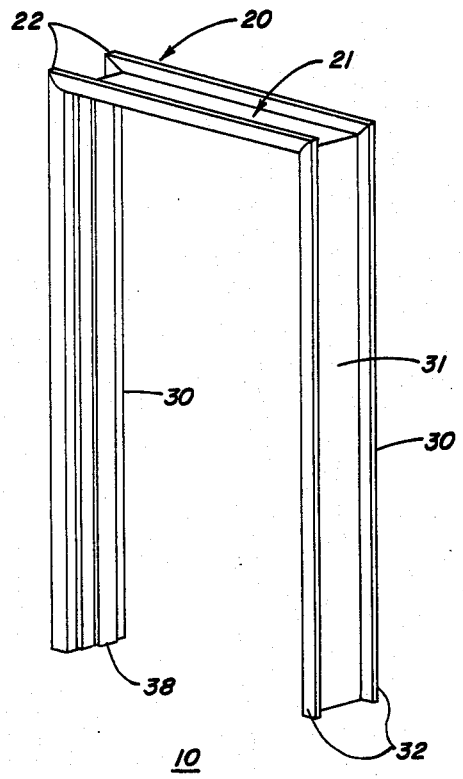
FIG. 1 is a perspective view of the door assembly of the present invention, as assembled.

Referring now to FIG. 1, it will be seen that the door assembly 10 of the present invention comprises three basic parts; a pair of vertically upstanding jamb units designated generally by the numeral 30 and a horizontally located header unit 20 spanning the upper ends of jamb unit 30.

Figure 2:
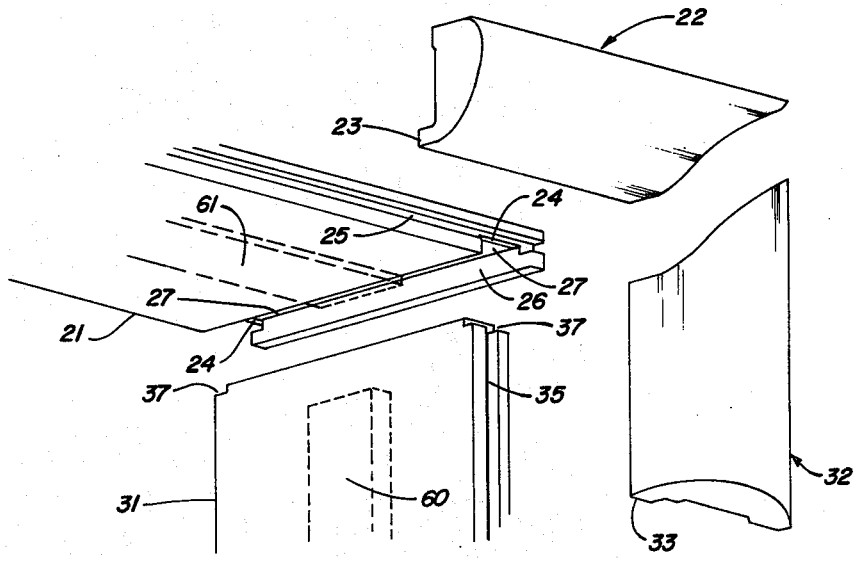
FIG. 2 is an exploded fragmentary perspective view of an upper corner of the door assembly of the present invention.
Figure 3:
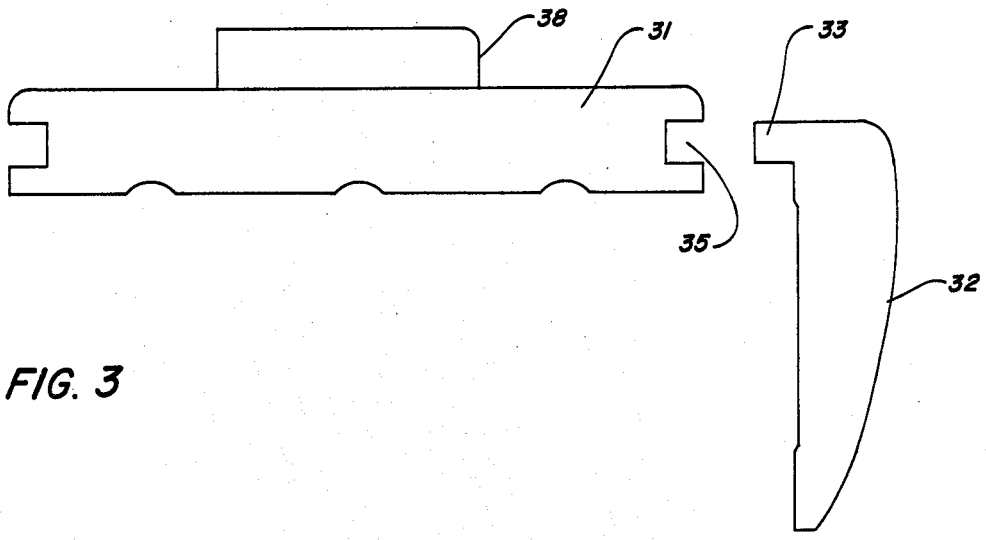
FIG. 3 is a plan sectional view of one jamb unit of the present invention.

Each of the jamb units 30, shown to advantage in FIG. 2 and 3, include a side panel 31 and a pair of casings 32. The longitudinal edges of side panel 31 are provided with longitudinal grooves 35 extending the entire length of the panel. Longitudinal grooves 35 are adapted to receive tongue 33 projecting transverse to the body section of casing 32. A door-stop 38 may be attached to the inside surface of side panel 31 in conventional manner. In addition, side panel 31 may also contain oppositely disposed right angle notches 37 cut in each of the upper corners transverse to the upper and longitudinal side edges thereof. Notches 37 are adapted to receive flange 24 of header member 21 as here-inafter shall be explained. Jamb units 30 may be manufactured in any desirable length, it being contemplated that the lower portion of the side panel and casings will be cut to length at the construction site. The upper portion of casing 32 is mitered at a 45 degree angle to complimentally engage a similar miter cut of horizontal casing 22.

Figure 4:
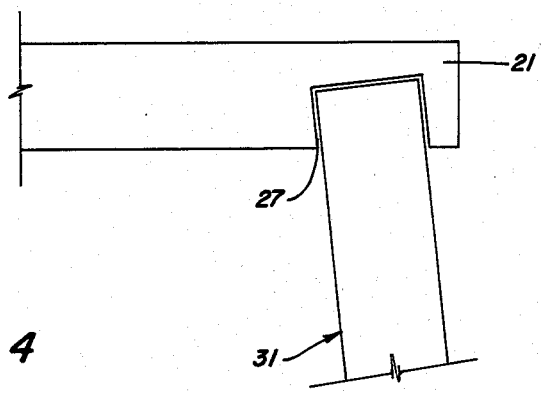
FIG. 4 is an exaggerated frontal view showing the outward bias placed upon a jamb unit.
Figure 5:
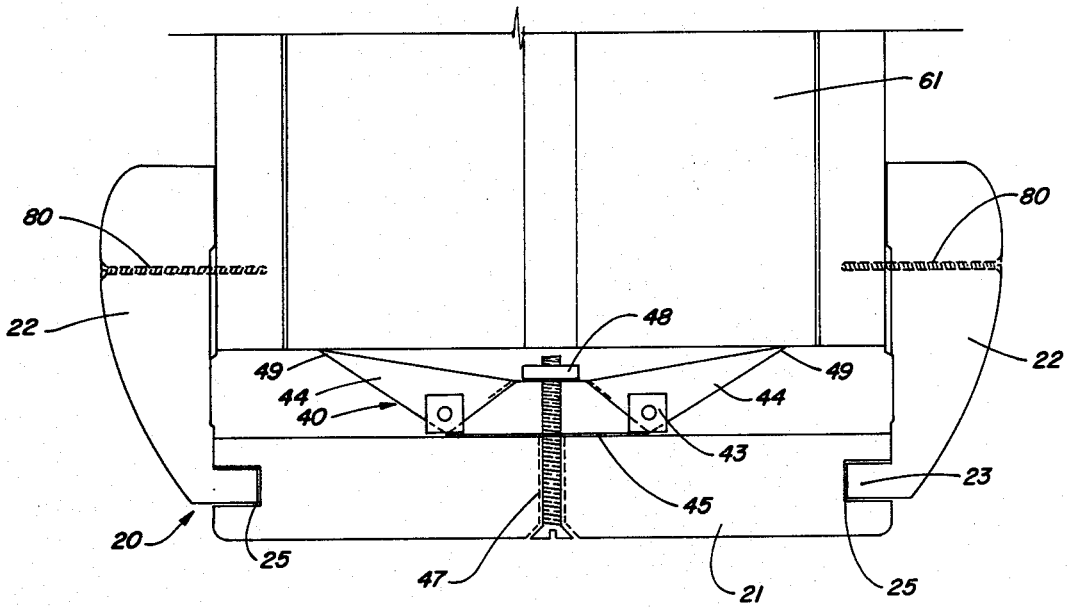
FIG. 5 is a side section of the header member, showing the pressure screw of the present invention.

Header unit 20, shown to advantage in FIGS. 2 and 5, includes a substantially planar header member 21 provided on each longitudinal edge with a longitudinal groove 25, adapted to receive transverse tongue 23 of horizontal casing 22. In accordance with the invention there are provided at each end of header member 21 a channel-like recess 27 extending substantially the width of the header member and parallel to the terminal ends thereof. Recesses 27 are cut, or otherwise formed, in header member 21 at a slight outward inclination of approximately 2 degrees from perpendicular, as shown exaggerated in FIG. 4. Recesses 27 are adapted to receive side panels 31 and, because of the "toeing out", impart a certain springiness to the side panels as they engage side stud 60 of the roughed in door frame. It is been found that this "toeing out" joint secures the contact of side panel 31 against supporting stud 60 and further prevents the loosening of attachment means such as nails or screws normally used to hold the side panel to the stud, and thereby prevents a general loosening of the door assembly due to house settling. Header member 21 may also include, adjacent each end, a pair of downwardly depending flanges 24 defining the terminal ends of recess 27, the flanges being parallel with the longitudinal edge of member 21. Flanges 24 are adapted to engage notches 37 of side panels 31 to prevent lateral movement of the side panels in relationship to the header member.

Referring now to FIG. 5, header member pressure means 40 is shown to advantage. Pressure means 40 includes a housing 45 which is substantially planar and rectangular in configuration; a pair of ears 44 pivotally engaging upturned flanges 43 of the housing; machine screw 47 threadably engaging an aperture in the center of the housing; and nut 48 threadably engaging screw 47 and further contacting the top portion of ears 44 of the pressure means. Before installation of header unit 20 to header stud 61, header pressure means 40 is attached to header member 21 by inserting screw 47 through a pre-drilled hole in the header member and attaching the housing by means of nut 48, as shown. It will be seen that once the header unit is installed that a downward pressure may be applied upon header member 21 by tightening nut 48 upon machine screw 47 thereby bringing free end terminal tips 49 into contact with header stud 61. In so doing, housing 45 is caused to exert a downward pressure on header member 21. It will therefor be appreciated, that the downward pressure exerted on head member 21 will be transmitted to the secured tongues 23 of casings 22. Casings 22, which have previously been nailed in place in conventional manner as by nails 80, shown in FIG. 5, can move only slightly if at all and therefor it will be seen that if any loosening of nails 80 in their relationship to header stud 61 or any loosening between tongue 23 of the casings and longitudinal groove 25 of header member 21, as due to natural settling of the structure has taken place, this can be easily remedied by simply tightening scrw 47.

For installation of assembly 10 in a roughed-in door frame, a header member 21 of proper width is chosen and pressure means 40 installed as previously explained. Side panels 31 and casings 32 are then cut to length and the top portion of panels 31 inserted into recesses 27 of header member 21 with flanges 24 engaging notches 37 to prevent lateral movement. The assembly, less casings, is then inserted into the roughed-in door frame with side panels 31 springingly engaging side studs 60 of the door frame. The header member 21 is then horizontally leveled and panels 31 vertically leveled; the panels being attached by nails or screws to stud 60. It is to be noted that there is a natural propensity in the "toeing out" procedure for side panels 31 to tightly engage stud 60, even without other attachment. Casings 22, with tongue 23 interlocking grooves 25 of member 21, are then nailed in place in conventional manner and pressure means 40 tightened snugly. Casings 32 with tongues 33 engaging longitudinal grooves 35 of side panel 31 are then nailed in place with the top mitered end engaging the mitered ends of casings 22, thereby completing the installation. Should settling thereafter occur, joints may be tightened periodically, as required, by simply tightening pressure means 40, as before described.

Having thus described in detail a preferred embodiment of the present invention, it is to be appreciated and will be apparent to those skilled in the art that many physical changes could be made in the apparatus without altering the inventive concepts and principles embodied therein. The present embodiment is therefor to be considered in all respects as illustrative and not restrictive, the scope of the invention being indicated by the appended claims rather than by the foregoing description, and all changes which come within the meaning and range of equivalency of the claims are therefor to be embraced therein.

I claim:

1. A prefabricated door assembly for installation in a roughed-in door frame comprising:

a pair of jamb units adapted for vertical positioning parallel to the sides of the door frame, each of said jamb units including a side panel having longitudinal grooves in opposing longitudinal edges thereof and a pair of vertically oriented casings, each having transverse tongues for engaging an opposing longitudinal groove of said side panel; and a header unit spanning the upper ends of said jamb units, said header unit including a header member having a pair of recesses on its under side adjacent opposing terminal ends thereof, the recesses adapted to receive the upper terminal ends of said side panels, said recesses inclined slightly outward from vertical to impress an outward pressure on said side panels so received, a pair of longitudinal grooves in opposing longitudinal edges of said header member and a pair of horizontally oriented casings, each casing having a transverse tongue for engaging an opposing longitudinal groove of said header member.

2. Apparatus as described in claim 1, further comprising header member pressure means extending between said header member and the door frame and operable to exert a downward pressure on said header member.

3. Apparatus as described in claim 1, wherein said header member includes adjacent each end thereof, a pair of oppositely disposed flanges, each flange downwardly depending co-extensive with the longitudinal edges of said header member and across the ends of each recess, and wherein each of said side panels include a pair of notches at opposing top terminal corners thereof, each of said notches adapted to receive a flange to prevent lateral movement of said side panels in relationship to said header member.

4. A prefabricated door assembly for installation in a roughed-in door frame comprising:

a pair of jamb units adapted for vertical positioning parallel to the sides of the door frame, each of said jamb units including a side panel and a pair of vertical casings, each of said side panels having longitudinal grooves in opposing longitudinal edges thereof and having a pair of notches at opposing top terminal corners thereof, each of said vertical casings having transverse tongues for engaging an opposing longitudinal groove of said side panel; and a header unit spanning the upper ends of said jamb units, said header unit including a header member, a pair of horizontal casings, and header member pressure means, said header member having a pair of recesses on its underside adjacent opposing terminal ends thereof, the recesses adapted to receive the upper terminal ends of said side panels, said recesses inclined slightly outward from vertical to impress an outward pressure on said side panels so received, said header member having a pair of oppositely disposed flanges, each flange downwardly depending co-extensive with the longitudinal edges of said header member and across the end of each recess, said flanges each adapted to engage a notch of said side panel to prevent lateral movement of said side panel in relationship to said header member, said header member having a pair of longitudinal grooves in opposing longitudinal edges thereof; said horizontal casings each having a transverse tongue for engaging an opposing longitudinal groove of said header member; and said header member pressure means extending between said header member and the top of the door frame and operable to exert a downward pressure on said header member.

* * * * *